US008493308B2

(12) United States Patent
Weng

(10) Patent No.: US 8,493,308 B2
(45) Date of Patent: Jul. 23, 2013

(54) SOURCE DRIVER HAVING CHARGE SHARING FUNCTION FOR REDUCING POWER CONSUMPTION AND DRIVING METHOD THEREOF

(75) Inventor: Meng-Tse Weng, Tainan County (TW)

(73) Assignee: Himax Technologies Limited, Tainan (TW)

( * ) Notice: Subject to any disclaimer, the term of this patent is extended or adjusted under 35 U.S.C. 154(b) by 427 days.

(21) Appl. No.: 12/467,470

(22) Filed: May 18, 2009

(65) Prior Publication Data

US 2010/0289791 A1 Nov. 18, 2010

(51) Int. Cl.
*G09G 3/36* (2006.01)

(52) U.S. Cl.
USPC ..... 345/98

(58) Field of Classification Search
USPC ..... 345/55, 87, 90, 96, 98, 100, 204, 345/208, 211, 212, 213; 349/149
See application file for complete search history.

(56) References Cited

U.S. PATENT DOCUMENTS

| | | | | |
|---|---|---|---|---|
| 6,784,866 | B2 * | 8/2004 | Udo et al. | 345/100 |
| 7,136,039 | B2 * | 11/2006 | Bu et al. | 345/98 |
| 2003/0201955 | A1 * | 10/2003 | Song et al. | 345/76 |
| 2004/0041763 | A1 * | 3/2004 | Kodama et al. | 345/87 |
| 2005/0151714 | A1 * | 7/2005 | Hirama | 345/100 |
| 2005/0219195 | A1 * | 10/2005 | Yano et al. | 345/100 |
| 2008/0136806 | A1 * | 6/2008 | Lee et al. | 345/212 |
| 2008/0303771 | A1 * | 12/2008 | Chen et al. | 345/94 |
| 2009/0153593 | A1 * | 6/2009 | Lee et al. | 345/690 |

* cited by examiner

*Primary Examiner* — Chanh Nguyen
*Assistant Examiner* — Pegeman Karimi
(74) *Attorney, Agent, or Firm* — J.C. Patents

(57) ABSTRACT

A source driver includes a plurality of first data channel pairs, a plurality of second data channel pairs, a first switch group, a second switch group, a third switch group, and a fourth switch group. Each of the first data channel pairs includes a first odd channel and a first even channel. The channels outputting voltages having the same polarity are short circuited together through the switch groups during a charge sharing period. As a result, the swings of the voltages of data lines coupled the corresponding channel are reduced, and further power consumption in the source driver could be reduced as compared with the related art.

12 Claims, 8 Drawing Sheets

SOURCE DRIVER HAVING CHARGE SHARING FUNCTION FOR REDUCING POWER CONSUMPTION AND DRIVING METHOD THEREOF

BACKGROUND OF THE INVENTION

1. Field of the Invention

The present invention relates to a source driver. More particularly, the present invention relates to a source driver for reducing power consumption thereof with a charge sharing function, and a driving method thereof.

2. Description of Related Art

In order to catch up with the modern lifestyle, video and image devices are becoming slimmer and lighter. Despite of advantages it may have, a conventional cathode-ray tube (CRT) display not only is large in bulk that occupies too much room because of its intrinsic structure of the electronic cavity, but also radiates rays which may hurt human eyes. Therefore, accompanying the development of optoelectronic technology and semi-conductor processing technology, flat panel displays including liquid crystal display (LCD), organic light-emitting diode (OLED) display and plasma display panel (PDP) are gradually becoming a mainstream in the display market.

Resolutions and refreshing frequencies of flat panel displays are continuously improving. Consequently, refreshing frequencies of scan lines are demanded to be more and more rapid, which contradicts the designs for power saving by system engineers. As a result, a technology for eliminating the contradiction therebetween called "smart charge sharing" technology is developed thereby.

FIGS. 1A and 1B are schematic diagrams of a conventional charge sharing technology. Referring to FIG. 1A, first, a display 100 includes a source driver 110 and a display panel 130. The display panel 130 includes a plurality of data lines DL1-DLm electrically connected to the source driver 110. The source driver 110 includes a plurality of data channels ch1-chm, and each of the data channels includes a corresponding output amplifier. For example, the data channel ch1 includes the output amplifier A1, the data channel ch2 includes the output amplifier A2, and so on. Each of the data channels is respectively connected to a corresponding data line through the output terminal of the corresponding output amplifier. The source driver 110 further includes a plurality of switches SW1-SWm-1 for connecting adjacent two data lines. For example, a switch SW1 is adapted for connecting the adjacent data lines DL1 and DL2. As shown in FIG. 1A, each data line is taken as a sum of loads of resistance and capacitance of a corresponding output amplifier.

FIG. 1C is a signal timing diagram of an even data line and an odd data line in FIG. 1B. Before the source driver 110 driving the display panel 130, voltages of each pair of the adjacent data lines (here the voltage V1 of the data line D1 and the voltage V2 of the data line D2 are used for illustration) are respectively higher and lower than a common voltage Vcom. Meanwhile, all of the switches SW1-SWm-1 are at turn-off status. At the instance that the source driver 110 starts to drive the display panel 130 in a charge sharing period t1, all of the switches SW1-SWm-1 will be switched to turn-on status as shown in FIG. 1B. At this certain instance, all amplifiers A1-Am are at disable status without current consumption. However, as the switches SW1-SWm-1 are at turn-on status, there will be a current flowing from a data line having a voltage higher than the common voltage Vcom to a data line having a voltage lower than the common voltage Vcom, the path of which is as illustrated of the arrowheads in FIG. 1B.

Thus, charges can be neutralized therein. After that, the switches SW1-SWm-1 will go back to the turn-off status in a normal driving period t2, while the source driver 110 can drive the display panel 130 as usual. After the normal driving period t2 is end, the process proceeds to a charge sharing period t3, and the internal circuit of the display 100 begins to perform the charge sharing operation again, so as to repeatedly perform the same activity.

In summary, the principle of the charge sharing technology is to reallocate energy (charges) stored in the data lines and whereby to drive the data lines to a half of the final value without power consumption. However, while the display panel 130 is driven with column inversion method, the voltage V1' of the data line D1 is not needed to swing lower than the common voltage Vcom in a frame, and in contrast, the voltage V2' of the data line D2 is not needed to swing higher than the common voltage Vcom in the frame, either. FIG. 1D is a signal timing diagram of an even data line and an odd data line in FIG. 1B while the display panel 130 is driven with column inversion method. Therefore, such charge sharing technology is not suitable for the specific condition mentioned above. Because the swings of the voltages are much than desire, extra power is consumed. It is desirable to design a proper source driver to solve the said problem.

SUMMARY OF THE INVENTION

Accordingly, the present invention is directed to provide a source driver, capable of controlling a charging sharing function thereof in a display to save the power consumption and to lower the operation temperature of the source driver.

The present invention provides a driving method of a source driver to save the power consumption and to lower the operation temperature of the source driver with a charging sharing function.

The present invention provides a source driver, which includes a plurality of first data channel pairs, a plurality of second data channel pairs, a first switch group, a second switch group, a third switch group, and a fourth switch group. Each of the first data channel pairs includes a first odd channel and a first even channel. The first odd channel and the first even channel are respectively used to output driving voltages having a first polarity or a second polarity during a first period. Similarly, each of the second data channel pairs includes a second odd channel and a second even channel. The second odd channel and the second even channel are respectively used to output driving voltages having the first polarity or the second polarity during the first period. The first switch group and the second switch group are both coupled to the first data channel pairs, but the third switch group and the fourth switch group are both coupled to the second data channel pairs. The first switch group conducts the first odd channels to each other according to a horizontal synchronous signal during a second period. Similarly, the second switch group conducts the first even channels to each other according to the horizontal synchronous signal during the second period. The third switch group conducts the second odd channels to each other according to the horizontal synchronous signal during the second period. The fourth switch group conducts the second even channels to each other according to the horizontal synchronous signal during the second period. Wherein, the first data channel pairs and the second data channel pairs are alternatively arranged. Furthermore, the first data channel pairs and the second data channel pairs respectively receive a first polarity control signal and a second polarity control signal to determine the polarities of driving voltages corresponding to the first odd channel, the first even channel, the second odd channel, and the second even channel.

The present invention provides a driving method of a source driver. The driving method includes the following steps. The source driver including a plurality of first data channel pairs and a plurality of second data channel pairs is provided. Wherein each of the first data channel pairs includes a first odd channel and a first even channel, and each of the second data channel pairs includes a second odd channel and a second even channel. Then, a display panel is driven with voltages having a first polarity by the first odd channels and the second even channels during a first period. Meanwhile, the display panel is driven with voltages having a second polarity by the first even channels and the second odd channels during the first period. Thereafter, the first odd channels are conducted to each other according to a horizontal synchronous signal during a second period. The first even channels are conducted to each other according to the horizontal synchronous signal during the second period. The second odd channels are conducted to each other according to the horizontal synchronous signal during the second period. The second even channels are conducted to each other according to the horizontal synchronous signal during the second period.

The source driver and the driving method thereof provided by the present invention control the charge sharing function in the provided source driver, such that the power consumption and the operation temperature of the source driver are both reduced.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 2:
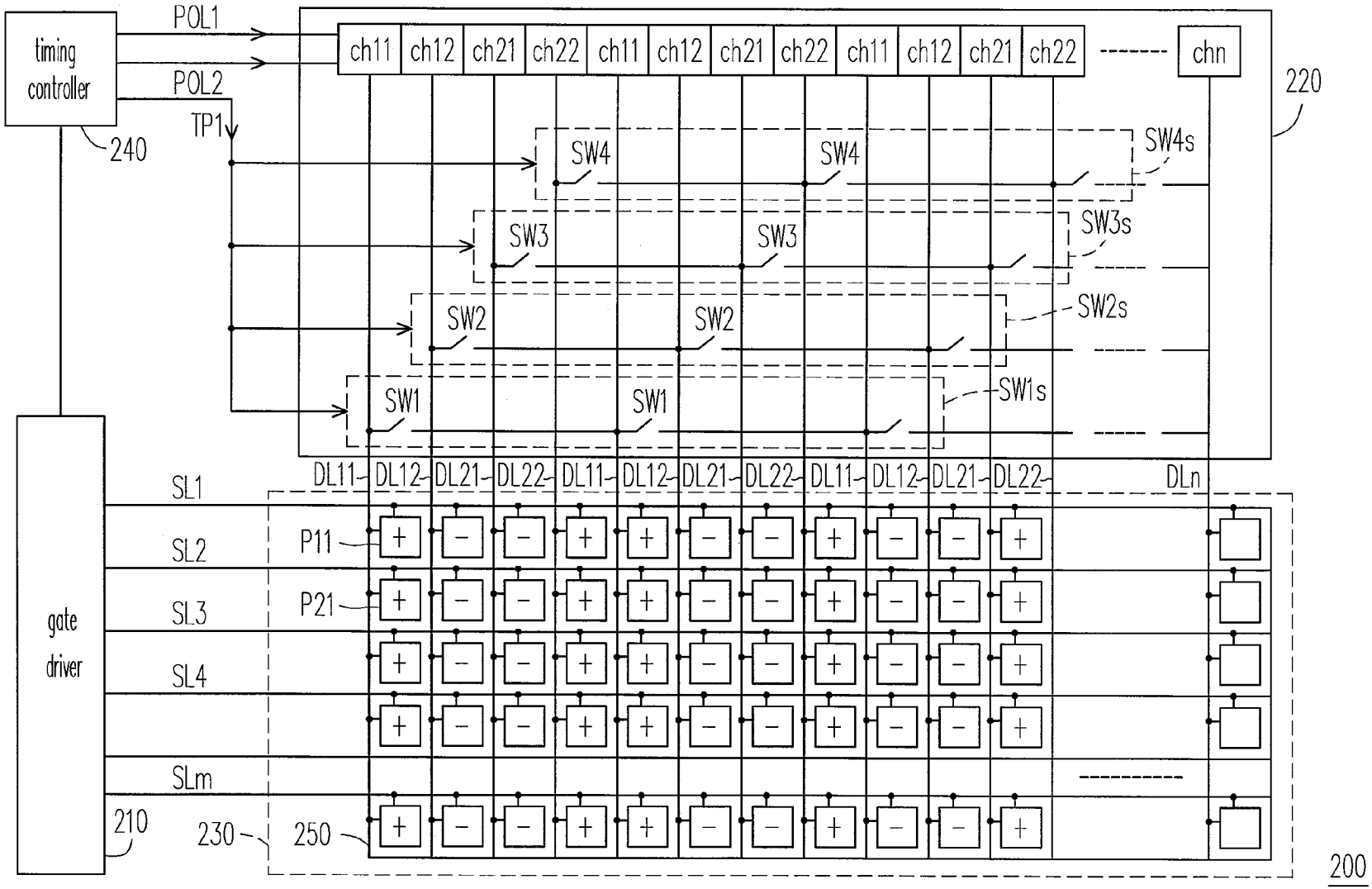
FIG. 2 is a block diagram for a circuit of a display according to an embodiment of the invention.

FIG. 2 is a block diagram for a circuit of a display 200 according to an embodiment of the invention. Referring to FIG. 2, the display 200 includes a gate driver 210, a source driver 220, a display panel 230, and a timing controller 240, wherein the display panel 230 includes a pixel array 250, and the timing controller 240 controls the source driver 220 and the gate driver 210.

The source driver 220 includes a plurality of first data channel pairs, a plurality of second data channel pairs, a first switch group SW1*s*, a second switch group SW2*s*, a third switch group SW3*s*, and a fourth switch group SW4*s*. In the present embodiment, a first odd channel ch1 and a neighboring first even channel ch12 form one of the first data channel pairs. Similarly, a second odd channel ch21 and a neighboring second even channel ch22 form one of the second data channel pairs. Besides, the first switch group SW1*s* and the second switch group SW2*s* are coupled to the first data channel pairs, and the third switch group SW3*s* and the fourth switch group SW4*s* are coupled to the second data channel pairs. For example, each of first switches SW1 of the first switch group SW1*s* connects one of the first odd channels ch11 and the neighboring first odd channel ch11 as shown in FIG. 2. Similarly, each of fourth switches SW4 of the fourth switch group SW4*s*, for example, connects one of the second even channels ch22 and the neighboring second even channel ch22.

In the present embodiment, the display panel 230 is driven by the source driver 220 with a column inversion method. The source driver 220 receives a first polarity control signal POL1 and a second polarity control signal POL2 provided by the timing controller 240. According to the first polarity control signal POL1, the first odd channels ch11 and the second even channels ch22 are controlled to output driving voltages having a positive polarity during a driving period. Similarly, according to the second polarity control signal POL2, the first even channels ch12 and the second odd channels ch21 are controlled to output driving voltages having a negatively polarity during the driving period. Accordingly, the display panel 230 is driven.

The first switch groups SW1*s*, the second switch groups SW2*s*, the third switch groups SW3*s*, and the fourth switch groups SW4*s* respectively conduct the first odd channels ch11 to each other, the first even channels ch12 to each other, the second odd channels to each other, and the second even channels ch22 to each other according to a horizontal synchronous signal TP1 during a charging sharing period. That is, the first odd channels ch11 which output the driving voltages with the same polarity, for example, are short circuited together, so that a charge sharing function is activated during the charging sharing period. Similarly, the charge sharing function is activated while the other channels ch12, ch21, and ch22 are short circuited together during the charging sharing period.

Figure 3:
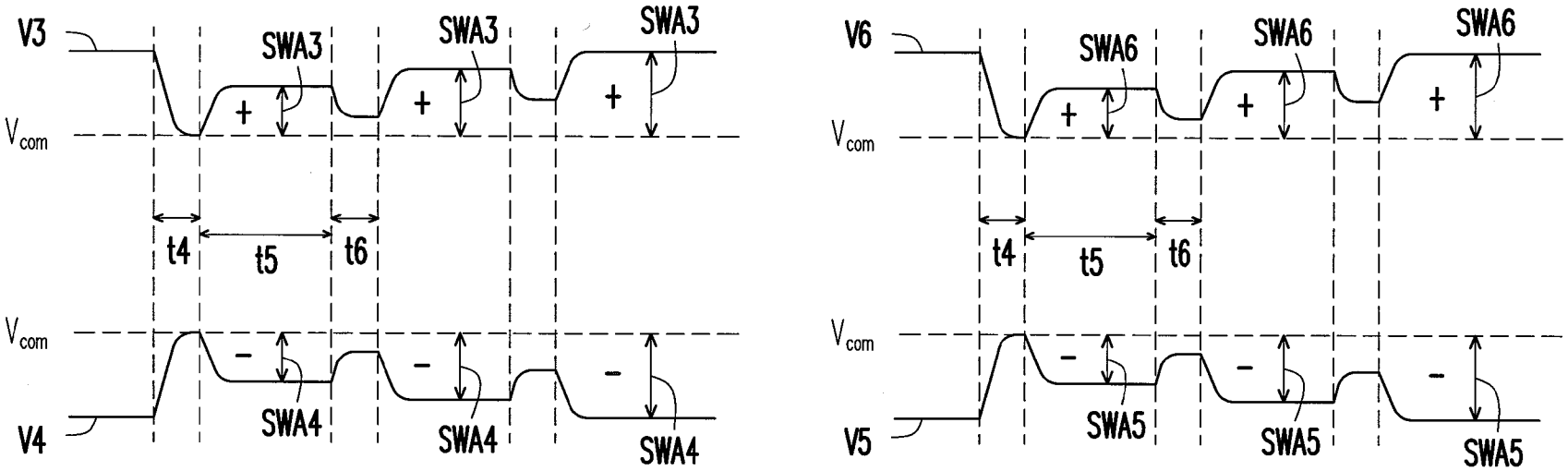
FIG. 3 is a signal timing diagram of data lines in FIG. 2.

FIG. 3 is a signal timing diagram of data lines in FIG. 2. Referring to FIG. 2 and FIG. 3, the pixel array 250 includes a plurality of data lines electrically coupled to the corresponding channels in the source driver 220, respectively. For example, the data lines DL11, DL12, DL21, and DL22 are respectively coupled to the corresponding first odd channels ch11, the corresponding first even channels ch12, the corresponding second odd channels ch21, and the corresponding second even channels ch22. FIG. 3 illustrates waveforms of the voltage V3 of the data lines DL11, the voltage V4 of the data lines DL12, the voltage V5 of the data lines DL21, and the voltage V6 of the data lines DL22 as an example.

Before the source driver 220 drives the display panel 230, the voltages V3 and V6 are higher than a common voltage Vcom, but the voltages V4 and V5 are lower than the common voltage Vcom. Meanwhile, all of the switches SW1, SW2, SW3, and SW4 are at turn-off status. At the instance that the source driver 220 starts to drive the display panel 230 in a charge sharing period t4, all of the switches SW1, SW2, SW3, and SW4 are switched at turn-on status according to the horizontal synchronous signal TP1. At this certain instance, all of the channels ch11-chn are at disable status without current consumption. Thus, charges are shared in the first odd channels ch11, the first even channels ch12, the second odd channels ch21, and the second even channels ch22, respectively. After that, the switches SW1, SW2, SW3, and SW4 return to the turn-off status in a normal driving period t5, while the source driver 220 drives the display panel 230 as usual. After the normal driving period t5 is end, the process proceeds to a charge sharing period t6, and the internal circuit of the display 200 begins to perform the charge sharing operation again, so as to repeatedly perform the same activity.

Figure 1A:
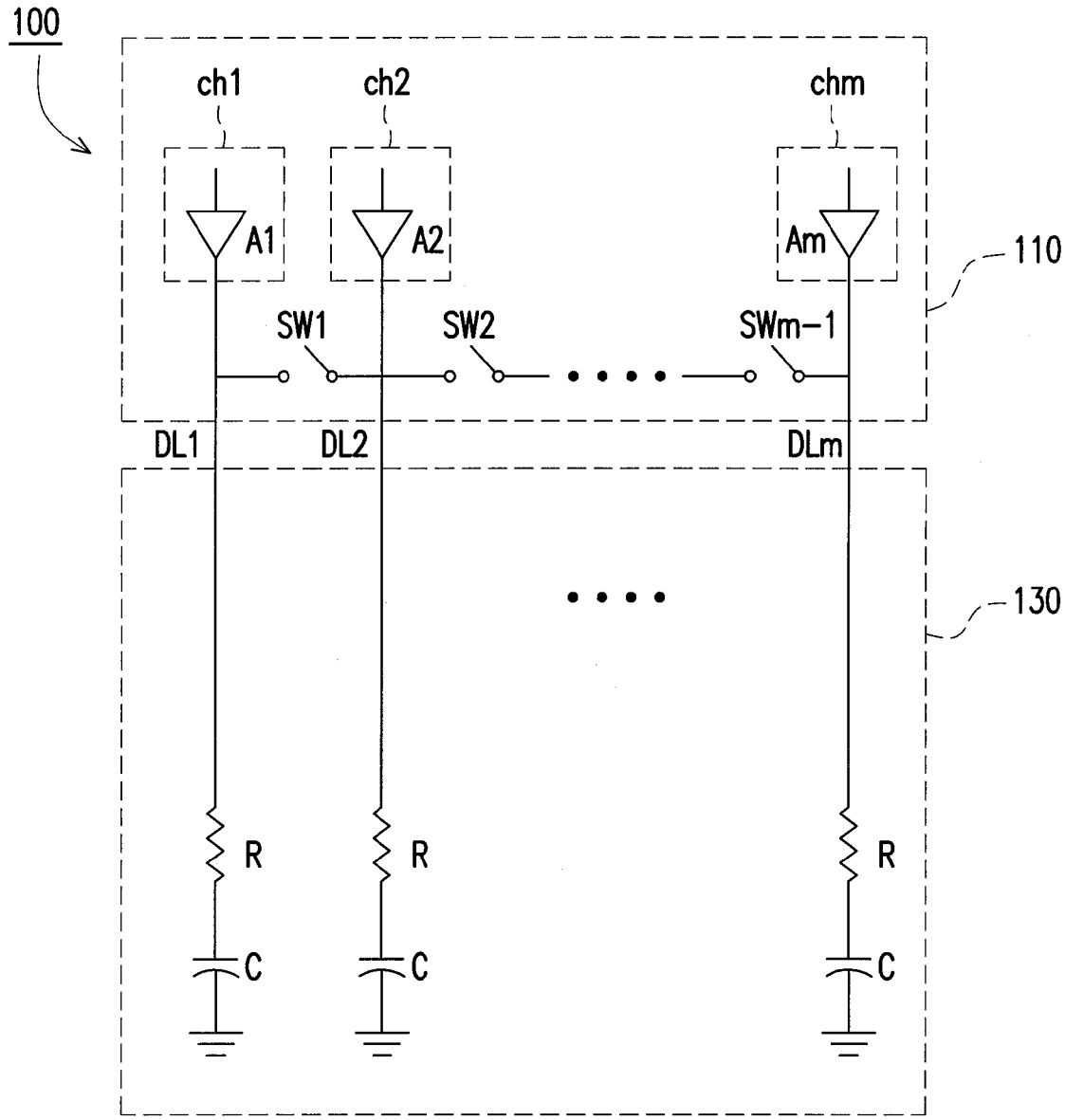
FIG. 1A (PRIOR ART)
FIGS. 1A and 1B are schematic diagrams of a conventional charge sharing technology.
Figure 1B:
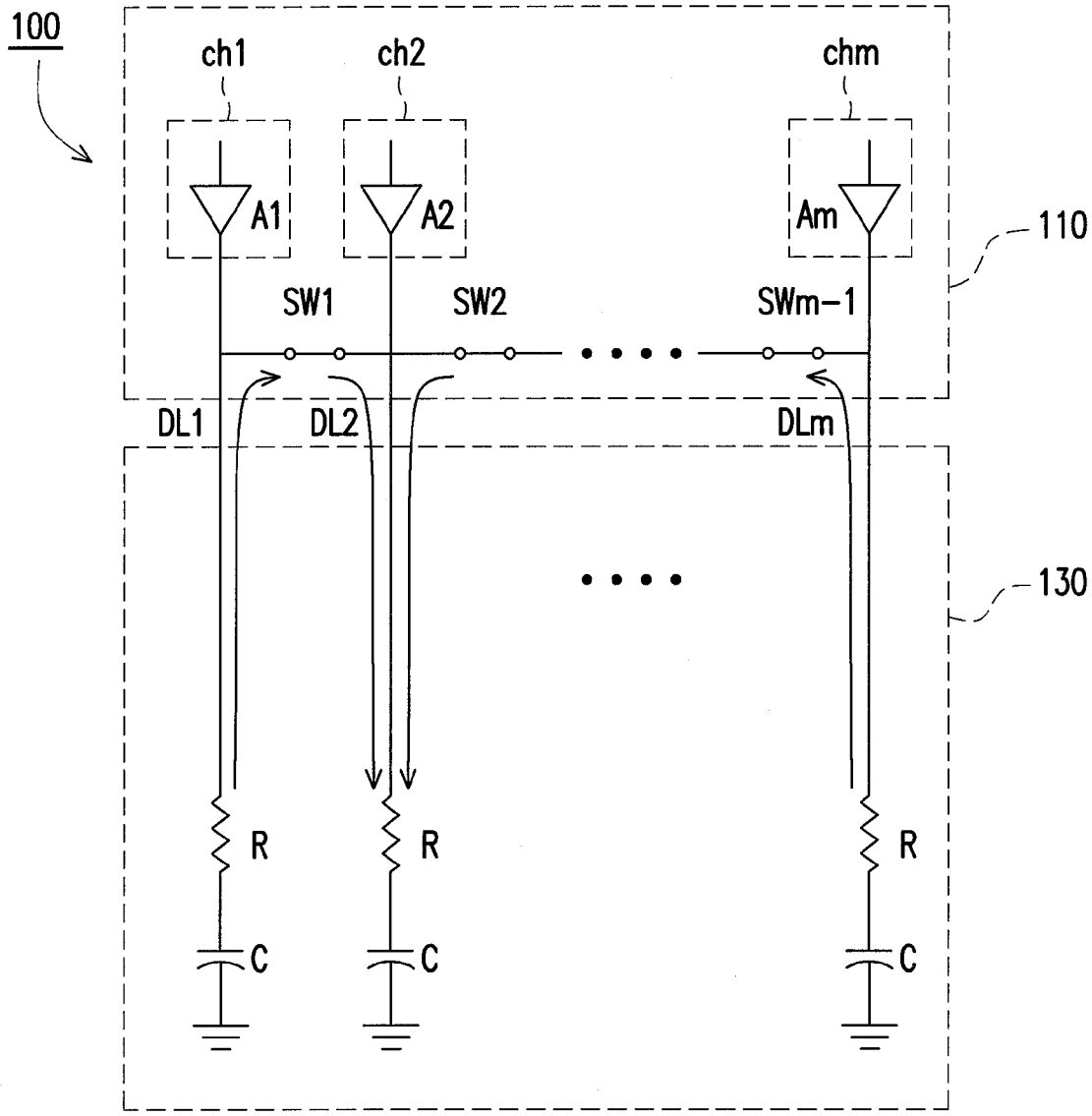
FIG. 1B (PRIOR ART)
Figure 1C:
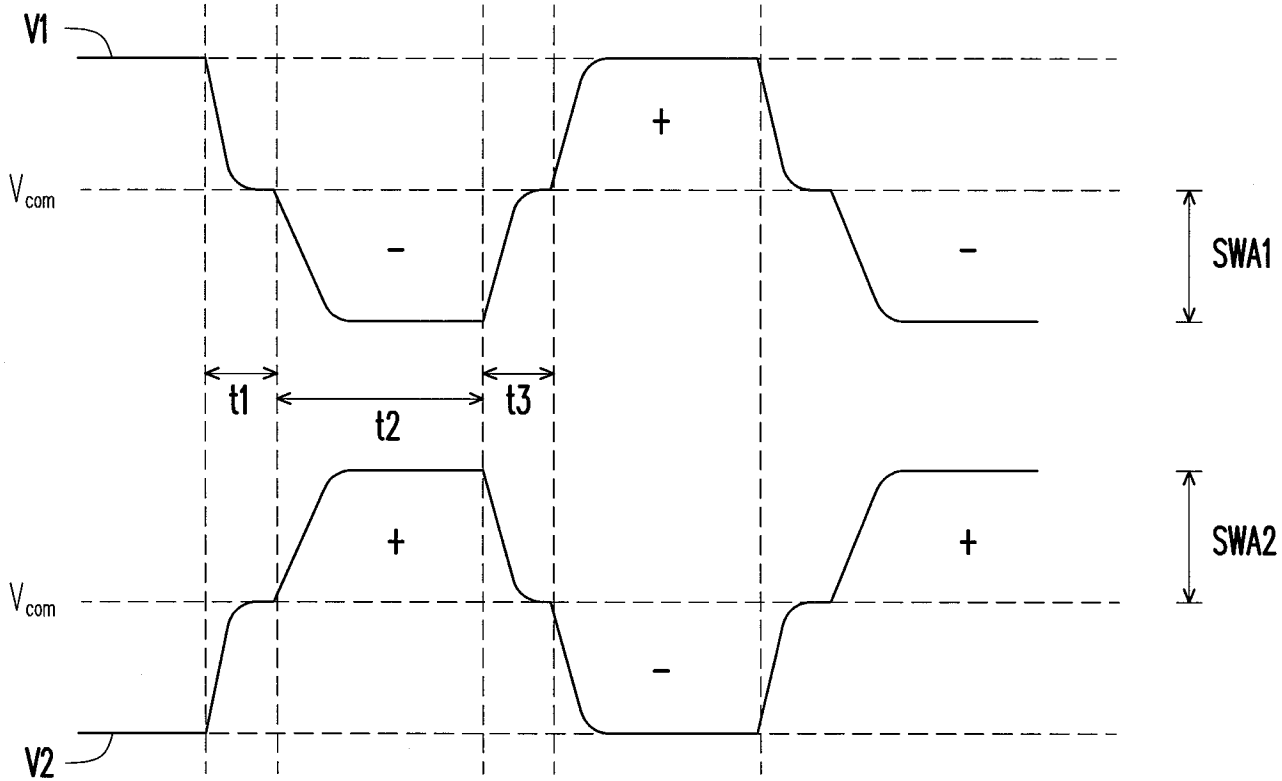
FIG. 1C (PRIOR ART)
FIG. 1C and FIG. 1D are signal timing diagrams of an even data line and an odd data line in FIG. 1B.
Figure 1D:
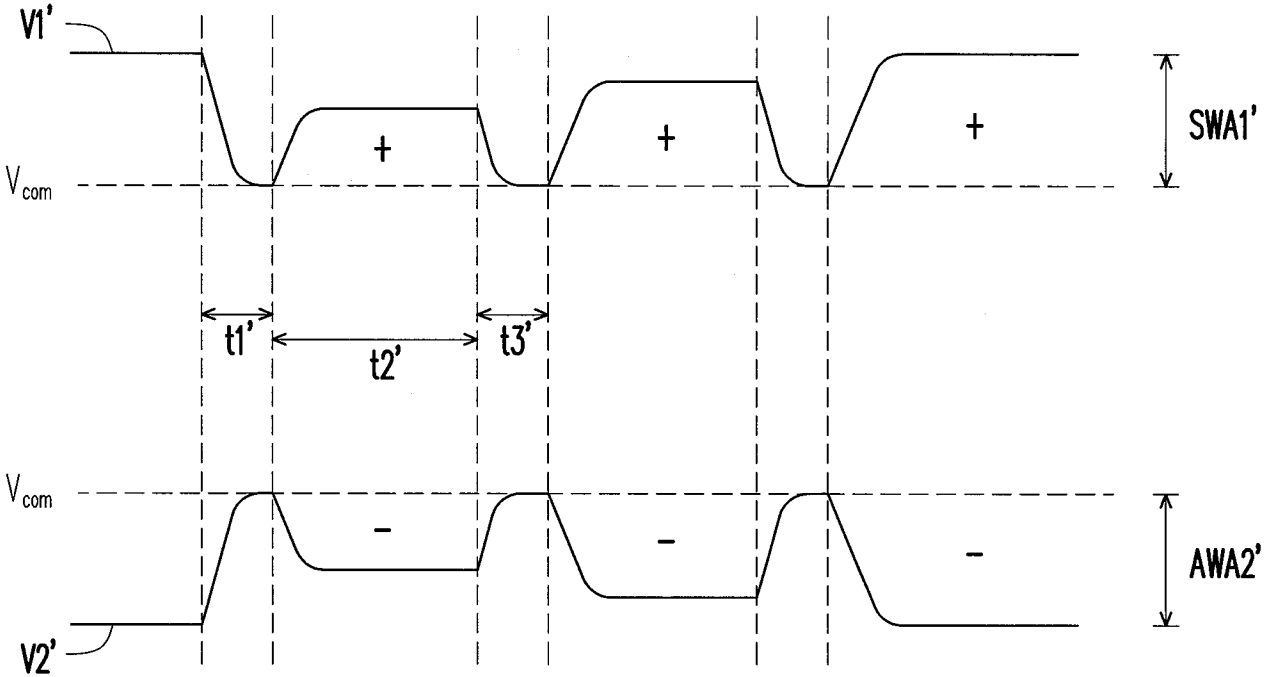
FIG. 1D (PRIOR ART)

As know from the signal timing diagram shown in FIG. 3, the swings SWA3 of the voltage V3, the swings SWA4 of the voltage V4, the swings SWA5 of the voltage V5, and the swings SWA6 of the voltage V6 are all smaller than the swings of the voltage illustrated in FIG. 1C and FIG. 1D. That is, while the channels outputting driving voltages having the same polarity are short circuited together during the charge sharing periods t4 and t6, the swings of the voltages of the data lines are reduced, and further power consumption in the source driver 220 is also reduced.

Figure 4:
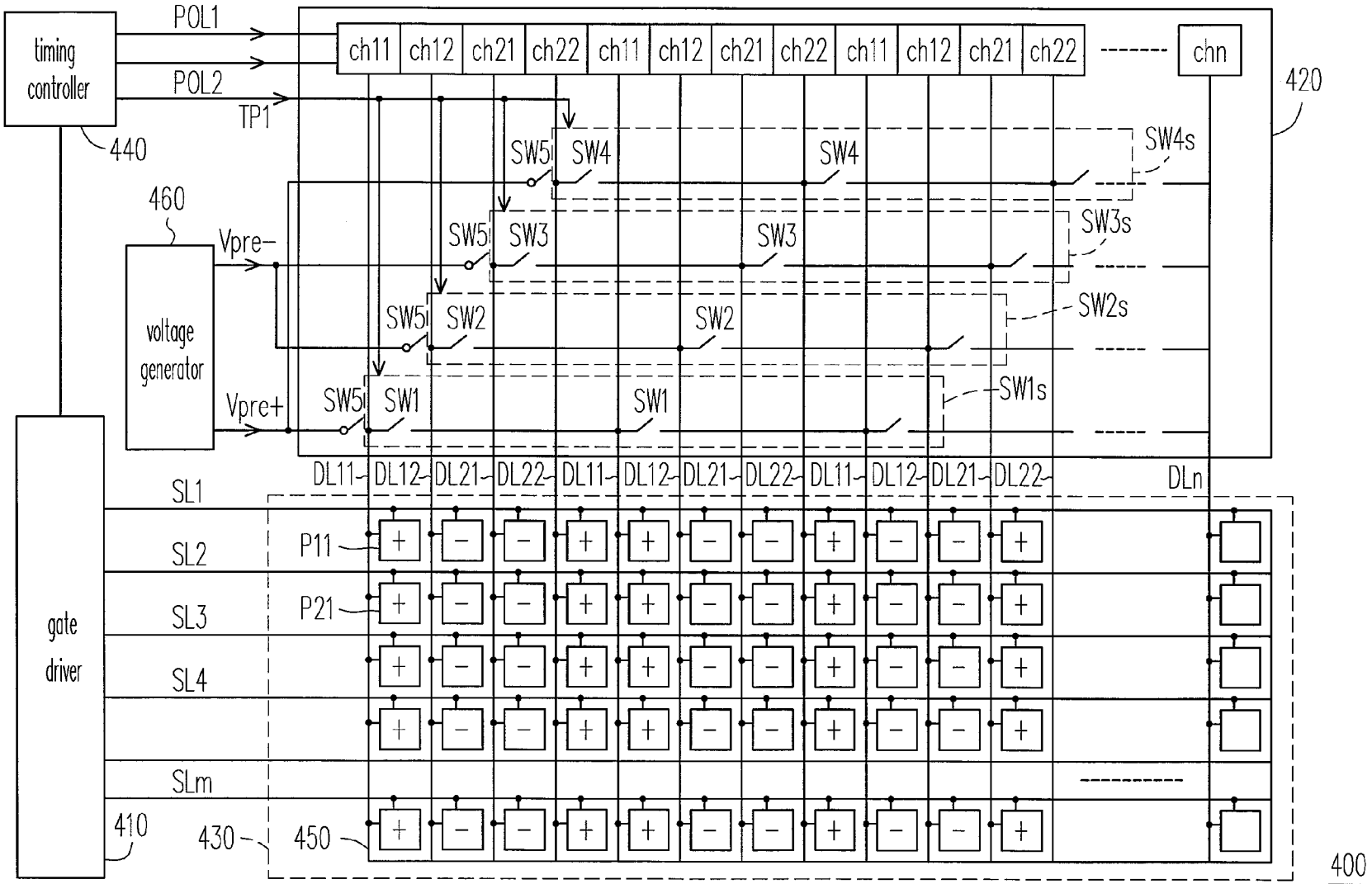
FIG. 4 is a block diagram for a circuit of a display according to an embodiment of the invention.

FIG. 4 is a block diagram for a circuit of a display 400 according to an embodiment of the invention. With reference to FIG. 4, the display 400 of the present embodiment is similar to the display 200 illustrated in the above embodiment except that the display 400 of the present embodiment further includes a voltage generator 460. The charge sharing function of the display 400 is supported to a pre-charge function. The voltage generator 460 includes a plurality of fifth switches SW5 respectively coupled to the corresponding data lines. Each of the fifth switches conducts the corresponding data lines to the voltage generator, so that the corresponding data lines receive a positive polarity pre-charge voltage Vpre+ or a negative polarity pre-charge voltage Vpre− during the charge sharing period. For example, the voltage generator 460 outputs the positive polarity pre-charge voltage Vpre+ to the data lines coupled to the first odd channels ch11 and the second even channels ch22 but the negative polarity pre-charge voltage Vpre− to the first even channels ch12 and the second odd channels ch21 during the charge sharing period.

Figure 5:
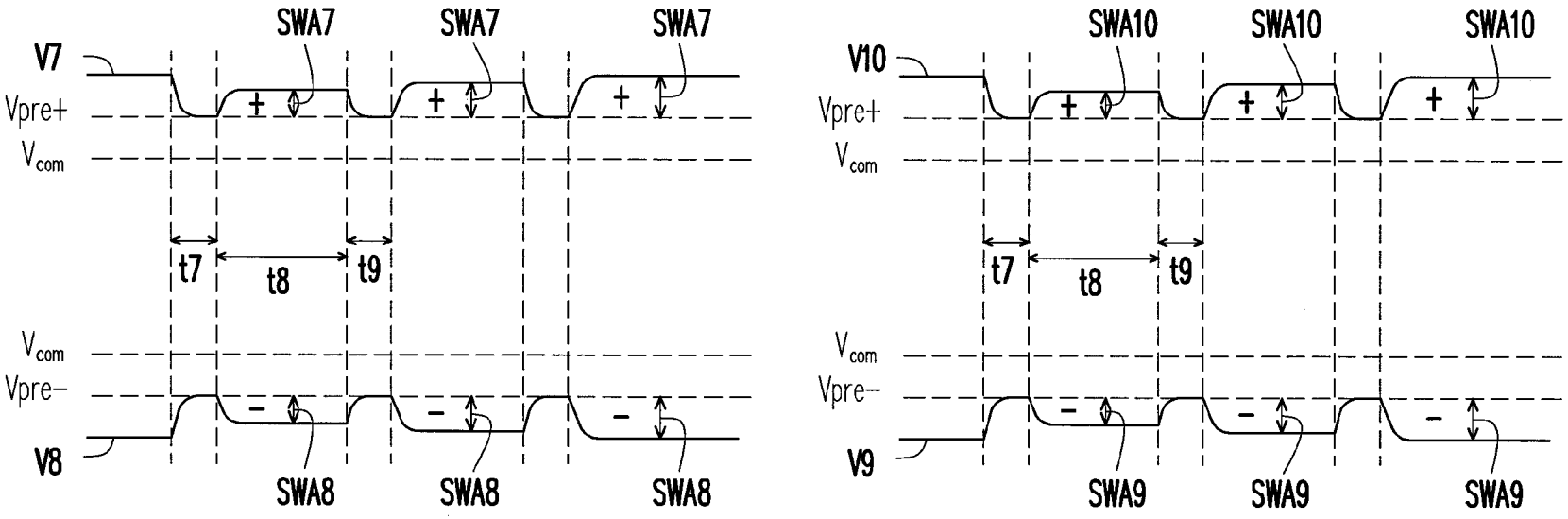
FIG. 5 illustrates a signal timing diagram of the data lines in FIG. 4 as an example.

FIG. 5 illustrates a signal timing diagram of the data lines DL11, D12, D21, and DL22 in FIG. 4 as an example. Referring to FIG. 4 and FIG. 5, during charge sharing periods t7 and t9, the third switches SW3 are at turn-on status. At this time, the voltage generator 460 outputs the positive polarity pre-charge voltage Vpre+ to the data lines DL11 and D22 through the switches SW3, but in the meanwhile, the voltage generator 460 outputs the negative polarity pre-charge voltage Vpre− to the data lines DL12 and D21 through the switches SW3. Therefore, during the charge sharing periods t7 and t9, the voltage V7 of the data lines DL11 and the voltage V10 of the data lines DL22 are forced to the pre-charge voltages Vpre+. Similarly, the voltage V8 of the data lines DL12 and the voltage V9 of the data lines DL21 are forced to the pre-charge voltages Vpre− during the charge sharing periods t7 and t9. As a result, during the charge sharing periods t7 and t9, the swings of the voltages of the data lines are reduced, and further power consumption in the source driver 420 is also reduced.

People who apply the present invention may determine the levels of the pre-charge voltages Vpre+ and Vpre− according to the requirement. For example, the levels of the pre-charge voltages Vpre+ and Vpre− may be set to the level the same as the common voltage Vcom. Alternatively, the level of the pre-charge voltage Vpre+ may be set to the level the same as a reference voltage of the positive polarity Gamma reference voltage, and the level of the pre-charge voltages Vpre− may be set to the level the same as a reference voltage of the negative polarity Gamma reference voltage. Alternatively, the pre-charge voltage Vpre+ can be set as the minimum positive polarity driving voltage on the scan line SL1-SLm, and the pre-charge voltage Vpre− can be set as the maximum negative polarity driving voltage on the scan line SL1-SLm.

The kinds of the display panels may have many varieties, and the signal timing diagrams of the data lines and the circuit diagrams of the displays schematically shown in FIG. 2-4 are only illustrated as an example for one skilled in the art to implement the present invention, rather than limiting the scope of the present invention.

In the present invention, in addition to the display, a driving method of the source driver for the display is further provided. For the method, enough teaching, suggestion, and implementation illustration are obtained from the above embodiments, so it is not described.

To sum up, in the source driver of the said embodiment, the channels outputting voltages having the same polarity are short circuited together through the switch groups during the charge sharing period. As a result, the swings of the voltages of the data lines coupled the channel are reduced during the charge sharing period, and further power consumption in the source driver could be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A source driver, comprising:

a plurality of first data channel pairs, each of the first data channel pairs comprising a first odd channel and a first even channel, and the first odd channel and the first even channel respectively used to output driving voltages having a first polarity or a second polarity during a first period;

a plurality of second data channel pairs, each of the second data channel pairs comprising a second odd channel and a second even channel, and the second odd channel and the second even channel respectively used to output driving voltages having the first polarity or the second polarity during the first period;

a first switch group coupled to the first data channel pairs and conducting the first odd channels to each other according to a horizontal synchronous signal during a second period, wherein when first switch group is turned on, the first odd channels are not conducted with the first even channels, the second odd channels, and the second even channels during the second period;

a second switch group coupled to the first data channel pairs and conducting the first even channels to each other according to the horizontal synchronous signal during the second period;

a third switch group coupled to the second data channel pairs and conducting the second odd channels to each other according to the horizontal synchronous signal during the second period; and a fourth switch group coupled to the second data channel pairs and conducting the second even channels to each other according to the horizontal synchronous signal during the second period, wherein the first data channel pairs and the second data channel pairs are alternatively arranged and respectively receive a first polarity control signal and a second polarity control signal to determine the polarities of driving voltages corresponding to the first odd channel, the first even channel, the second odd channel, and the second even channel; and wherein the first odd channels, the first even channels, the second odd channels, and the second even channels are repeatedly arranged in a cycle of four channels, in each cycle, the first odd channel, the first even channel, the second odd channel, and the second even channel are sequentially arranged, and the first even channel is directly adjacent to the first odd channel, the second odd channel is directly adjacent to the first even channel, and the second even channel is directly adjacent to the second odd channel, and the first odd channels, the first even channels, the second odd channels, and the second even channels each comprise a plurality of directly connected switches.

2. The source driver as claimed in claim 1, further comprising a voltage generator, the voltage generator providing a first pre-charge voltage to data lines of the display panel coupled to the first odd channel and the second even channel, and the voltage generator also providing a second pre-charge voltage to data lines of the display panel coupled to the first even channel and the second odd channel during the second period.

3. The source driver as claimed in claim 2, wherein the voltage generator comprises a plurality of fifth switches respectively coupled to the corresponding data lines, and each of the fifth switches conducts the corresponding data lines to the voltage generator, so that the corresponding data lines receive the first pre-charge voltage or the second pre-charge voltage during the second period.

4. The source driver as claimed in claim 1, wherein the first polarity control signal and the second polarity control signal are both provided by a timing controller.

5. The source driver as claimed in claim 1, wherein a charge sharing function of the source driver is activated while the first odd channels, the first even channels, the second odd channels, and the second even channels are respectively conducted to each other during the second period.

6. A driving method of a source driver, the driving method comprising:

providing the source driver comprising a plurality of first data channel pairs and a plurality of second data channel pairs, wherein each of the first data channel pairs comprises a first odd channel and a first even channel, and each of the second data channel pairs comprises a second odd channel and a second even channel;

driving a display panel with voltages having a first polarity by the first odd channels and the second even channels during a first period;

driving the display panel with voltages having a second polarity by the first even channels and the second odd channels during the first period;

conducting the first odd channels to each other according to a horizontal synchronous signal during a second period, wherein when a switch group is turned on, the first odd channels are not conducted with the first even channels, the second odd channels, and the second even channels during the second period;

conducting the first even channels to each other according to the horizontal synchronous signal during the second period;

conducting the second odd channels to each other according to the horizontal synchronous signal during the second period; and conducting the second even channels to each other according to the horizontal synchronous signal during the second period; and wherein the first odd channels, the first even channels, the second odd channels, and the second even channels are repeatedly arranged in a cycle of four channels, in each cycle, the first odd channel, the first even channel, the second odd channel, and the second even channel are sequentially arranged, and the first even channel is directly adjacent to the first odd channel, the second odd channel is directly adjacent to the first even channel, and the second even channel is directly adjacent to the second odd channel, and the first odd channels, the first even channels, the second odd channels, and the second even channels each comprise a plurality of directly connected switches.

7. The driving method as claimed in claim 6, before the steps of driving the display panel, receiving a first polarity control signal and a second polarity control signal to determine the polarities of driving voltages corresponding to the first odd channel, the first even channel, the second odd channel, and the second even channel.

8. The driving method as claimed in claim 6, further comprising:

providing a first pre-charge voltage to data lines of the display panel coupled to the first odd channel and the second even channel by a voltage generator during the second period; and providing a second pre-charge voltage to data lines of the display panel coupled to the first even channel and the second odd channel by the voltage generator during the second period.

9. The driving method as claimed in claim 8, wherein the voltage generator comprises a plurality of fifth switches respectively coupled to the corresponding data lines.

10. The driving method as claimed in claim 9, further comprising:

conducting the corresponding data lines to the voltage generator by the fifth switches, so that the corresponding data lines receive the first pre-charge voltage or the second pre-charge voltage during the second period.

11. The driving method as claimed in claim 6, wherein the first polarity control signal and the second polarity control signal are both provided by a timing controller.

12. The driving method as claimed in claim 6, wherein a charge sharing function of the source driver is activated while the first odd channels, the first even channels, the second odd channels, and the second even channels are respectively conducted to each other during the second period.

* * * * *